US009896938B2

(12) United States Patent
Tucker et al.

(10) Patent No.: US 9,896,938 B2
(45) Date of Patent: Feb. 20, 2018

(54) GAS TURBINE ENGINES WITH INTERNALLY STRETCHED TIE SHAFTS

(71) Applicant: HONEYWELL INTERNATIONAL INC., Morristown, NJ (US)

(72) Inventors: Bradley Reed Tucker, Chandler, AZ (US); Cristopher Frost, Scottsdale, AZ (US); Clay Johnstun, Chandler, AZ (US); Mike O'Brien, Goodyear, AZ (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 380 days.

(21) Appl. No.: 14/614,904

(22) Filed: Feb. 5, 2015

(65) Prior Publication Data

US 2016/0230560 A1 Aug. 11, 2016

(51) Int. Cl.

| | |
|---|---|
| ***F01D 25/24*** | (2006.01) |
| ***F01D 5/06*** | (2006.01) |
| ***F01D 5/00*** | (2006.01) |
| ***F04D 29/32*** | (2006.01) |
| ***F01D 5/02*** | (2006.01) |

(52) U.S. Cl.

CPC ..... *F01D 5/066* (2013.01); *F01D 5/005* (2013.01); *F01D 5/025* (2013.01); *F01D 5/026* (2013.01); *F04D 29/321* (2013.01); *F05B 2260/301* (2013.01); *F05D 2220/32* (2013.01); *F05D 2230/60* (2013.01); *F05D 2230/70* (2013.01); *F05D 2230/72* (2013.01); *F05D 2240/24* (2013.01); *F05D 2240/61* (2013.01); *F05D 2250/281* (2013.01); *F05D 2260/31* (2013.01)

(58) Field of Classification Search

CPC ..... F01D 5/066; F01D 5/026; F01D 5/005; F05B 2260/301; F05D 2230/60; F05D 2240/24; F05D 2230/72; F05D 2230/70; F05D 2220/32; F05D 2240/61

See application file for complete search history.

(56) References Cited

U.S. PATENT DOCUMENTS

| | | | | |
|---|---|---|---|---|
| 4,624,041 | A | 11/1986 | Gathright et al. | |
| 4,977,661 | A * | 12/1990 | Wood | B25B 27/062 29/261 |
| 5,220,784 | A | 6/1993 | Wilcox | |
| 6,267,553 | B1 | 7/2001 | Burge | |
| 6,606,863 | B2 * | 8/2003 | Napier | F01D 5/066 415/216.1 |

(Continued)

FOREIGN PATENT DOCUMENTS

| | | |
|---|---|---|
| EP | 2365184 A2 | 9/2011 |
| EP | 2565381 A2 | 3/2013 |

OTHER PUBLICATIONS

EP Extended Search Report for 16153549.7 -1610 dated Jun. 8, 2016.

*Primary Examiner* — Umashankar Venkatesan
(74) *Attorney, Agent, or Firm* — Lorenz & Kopf, LLP

(57) ABSTRACT

A tie shaft for a rotating group of an engine core includes a cylindrical body having an internal surface and an external surface and extending between a forward end and an aft end. The tie shaft further includes a first group of internal grooves on the internal surface of the cylindrical body proximate to the forward end and a second group of internal grooves on the internal surface of the cylindrical body proximate to the aft end.

16 Claims, 14 Drawing Sheets

(56) References Cited

U.S. PATENT DOCUMENTS

| | | | | |
|---|---|---|---|---|
| 7,452,188 | B2 * | 11/2008 | Bouchard | F01D 5/066 416/204 R |
| 7,470,115 | B2 | 12/2008 | Meacham et al. | |
| 8,100,666 | B2 | 1/2012 | Makuszewski | |
| 8,292,590 | B2 | 10/2012 | Leneweaver | |
| 8,517,687 | B2 | 8/2013 | Benjamin et al. | |
| 8,650,885 | B2 * | 2/2014 | Reinhardt | F01D 5/066 415/216.1 |
| 2007/0286733 | A1 | 12/2007 | Bouchard | |
| 2011/0219781 | A1 | 9/2011 | Benjamin et al. | |
| 2011/0223026 | A1 * | 9/2011 | Benjamin | F01D 5/066 416/198 A |
| 2011/0225822 | A1 | 9/2011 | Humhauser | |
| 2012/0027508 | A1 * | 2/2012 | Juh | F01D 5/066 403/319 |
| 2013/0081406 | A1 | 4/2013 | Malmborg et al. | |
| 2013/0202349 | A1 | 8/2013 | Coffin | |
| 2014/0010648 | A1 | 1/2014 | Muldoon | |
| 2014/0023486 | A1 | 1/2014 | Benjamin et al. | |
| 2014/0041197 | A1 * | 2/2014 | Juh | F01D 5/066 29/464 |

* cited by examiner

GAS TURBINE ENGINES WITH INTERNALLY STRETCHED TIE SHAFTS

TECHNICAL FIELD

The following discussion generally relates to gas turbine engine systems and methods, and more particularly, to systems and methods associated with a tie shaft of a gas turbine engine.

BACKGROUND

A gas turbine engine may be used to power various types of vehicles and systems, including aircraft. A typical gas turbine engine may include, for example, a compressor section, a combustion section, a turbine section, and an exhaust section. During operation, the compressor section raises the pressure of inlet air, and the compressed air is mixed with fuel and ignited in the combustion section. The high-energy combustion gases flow through the turbine section, thereby causing rotationally mounted turbine blades to rotate and generate energy. The air exiting the turbine section is exhausted from the engine via the exhaust section. Energy extracted by the turbine section may drive the fans, compressors, power gearboxes, generators, and other external devices.

Many gas turbine engines include multiple stages of compressors and turbines arranged in series. For example, a conventional two-stage gas turbine engine includes, in flow-path order: a fan and/or a low pressure compressor, a high pressure compressor, a combustor, a high pressure turbine, and a low pressure turbine and/or power turbine. Two or more these components may be considered a rotating group that share a common tie shaft that imparts an axial force to maintain the position and alignment of the rotating components. Generally, however, given the complex structure and function of the various components associated with the tie shaft, it may be challenging or impossible to assemble and disassemble selected components without complete disassembly of the rotating group.

This is particularly an issue because certain engine components may require more frequent cleaning, repair, and disassembly than other components. For example, combustors and high pressure turbine vanes and blades often require more frequent maintenance than high pressure compressor vanes and rotors. Service issues may be further complicated by recent advancements in gas turbine engine technology involving reduced physical size and increased speeds and temperatures that make the conventional mechanisms for accessing the components associated with the tie shaft more challenging.

Accordingly, it is desirable to provide gas turbine engines that enable a more efficient manner for selective assembly and disassembly of components while meeting the mechanical limitations of current engine requirements. Furthermore, other desirable features and characteristics of the present invention will become apparent from the subsequent detailed description of the invention and the appended claims, taken in conjunction with the accompanying drawings and this background of the invention.

BRIEF SUMMARY

In an exemplary embodiment, a tie shaft for a rotating group of an engine core includes a cylindrical body having an internal surface and an external surface and extending between a forward end and an aft end. The tie shaft further includes a first group of internal grooves on the internal surface of the cylindrical body proximate to the forward end and a second group of internal grooves on the internal surface of the cylindrical body proximate to the aft end.

In another exemplary embodiment, a rotating assembly for a gas turbine engine includes at least two rotating group components defining a bore and a tie shaft extending through the bore and axially retaining the at least two rotating group components during operation of the gas turbine engine. The tie shaft has a forward end and an aft end and defining an interior surface. The tie shaft includes a first at least one internal groove on the interior surface at the forward end and a second at least one internal groove on the interior surface at the aft end.

In a further exemplary embodiment, a method is provided for servicing an engine assembly with a rotating group axially retained by a tie shaft. The method includes inserting a stretch tool assembly through the tie shaft; exerting an outward axial force on the interior surface of the tie shaft at a forward end and at an aft end to stretch the tie shaft to axially decouple the tie shaft from the rotating group; and removing at least one component of the rotating group from the tie shaft.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Broadly, exemplary embodiments discussed herein include gas turbine engines with improved modularity. In particular, the tie shaft of a gas turbine engine may have features that enable engagement with a tool assembly such that components retained by the tie shaft may be assembled and disassembled in a more efficient manner. In one exemplary embodiment, the tie shaft includes internal grooves that enable the tie shaft to be internally stretched by the tool assembly.

Figure 1:
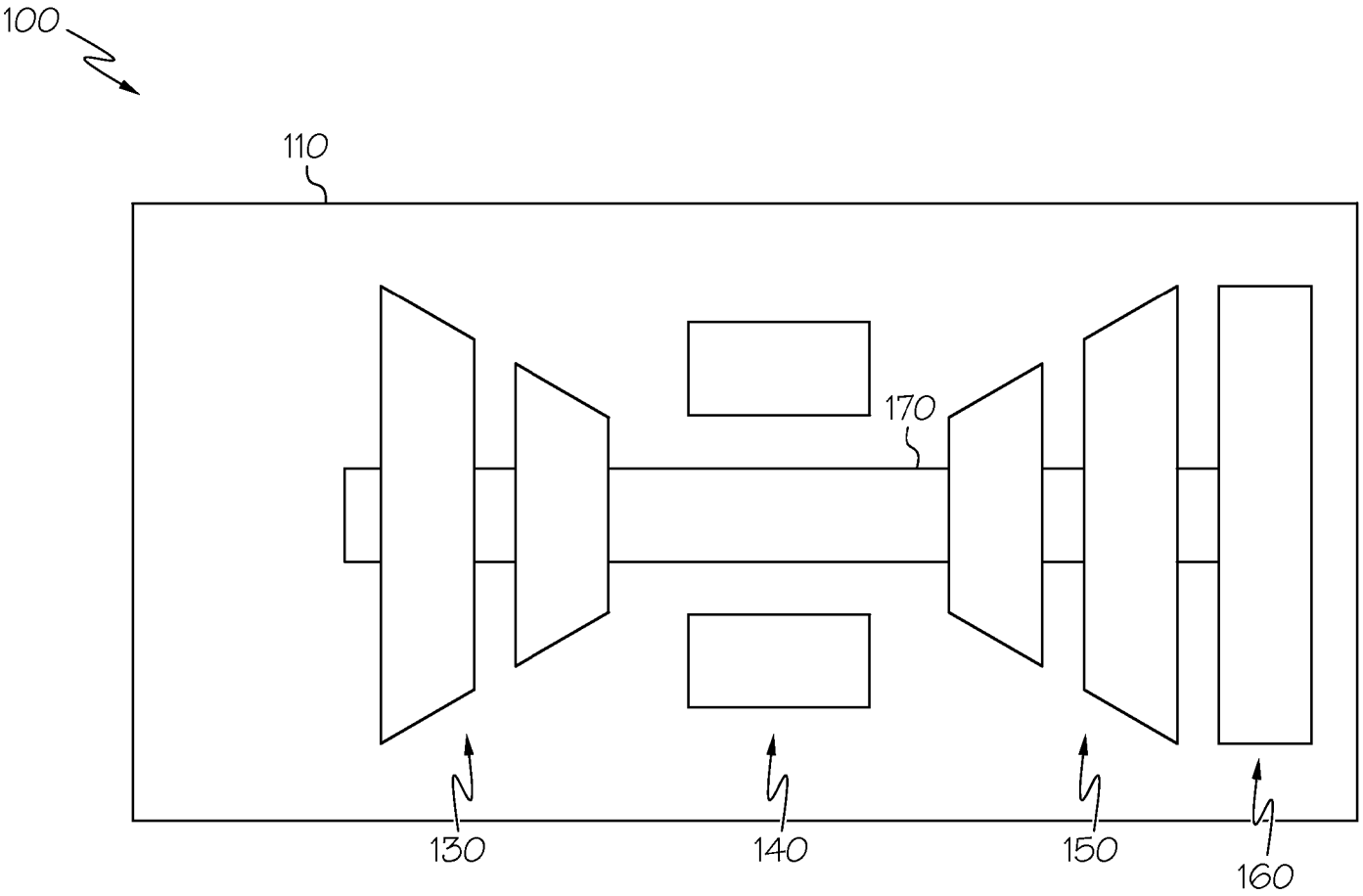
FIG. 1 is a simplified cross-sectional side view of a gas turbine engine according to an exemplary embodiment.

FIG. 1 is a simplified, cross-sectional view of a gas turbine engine 100 according to an embodiment. The engine 100 may be disposed in an engine case 110 and may include a compressor section 130, a combustion section 140, a turbine section 150, and an exhaust section 160 mounted on a shaft assembly 170. The compressor section 130 may include a series of compressors that raise the pressure of the air entering the engine 100. The compressors then direct the compressed air into the combustion section 140. In the combustion section 140, the high pressure air is mixed with fuel and combusted. The combusted air is then directed into the turbine section 150.

The turbine section 150 may include a series of turbines disposed in axial flow series. The combusted air from the combustion section 140 expands through and rotates the turbines prior to being exhausted through the exhaust section 160. In one embodiment, the turbines rotate to drive equipment in the engine 100 via concentrically disposed shafts or spools within the shaft assembly 170. Specifically, the turbines may drive the compressors via one or more rotors. FIG. 1 depicts one exemplary configuration, and other embodiments may have alternate arrangements. The exemplary embodiments discussed herein are not limited to use in conjunction with a particular type of turbine engine.

Figure 2:
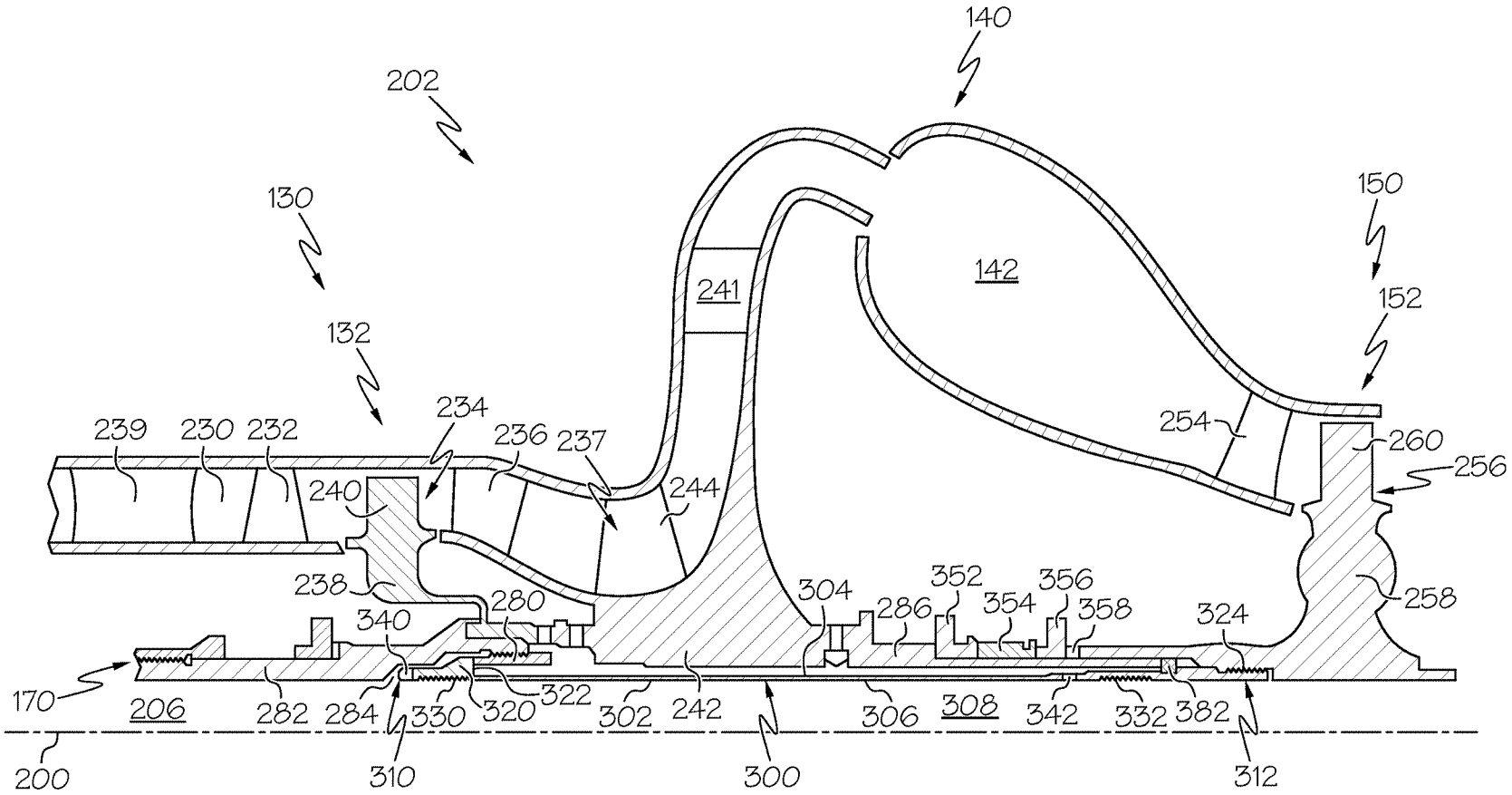
FIG. 2 is a partial cross-sectional view of high pressure core retained by a tie shaft suitable for use with the engine of FIG. 1 in accordance with an exemplary embodiment.

FIG. 2 is a more detailed partial cross-sectional view of the shaft assembly 170 and portions of the compressor section 130, the combustion section 140, and the turbine section 150 of the engine 100 of FIG. 1 in accordance with an exemplary embodiment. In FIG. 2, only half the cross-sectional view of the shaft assembly 170 is shown; the other half would be substantially rotationally symmetric about a centerline and axis of rotation 200. Additionally, certain aspects of the engine 100 may not be shown in FIG. 2, or only schematically shown, for clarity in the relevant description of exemplary embodiments. As noted above, the compressor and turbine sections 130, 150 may have multiple stages. In the view of FIG. 2, the compressor section 130 may include a high pressure compressor 132 immediately upstream of the combustion section 140, and the turbine section 150 may include a high pressure turbine 152 immediately downstream of the combustion section 140. As described in greater detail below, the high pressure compressor 132, the combustion section 140, and the high pressure turbine 152 may collectively be referred to as a high pressure core 202.

Generally, the high pressure compressor 132 defines a flow path 230 and includes one or more stator assemblies 232, 236, 239 and rotor assemblies 234, 237. The stator assemblies 232, 236, 239, 241 are stationary and function to direct the air through the flow path 230. Typically, the compressor rotor assemblies 234, 237 include one or more rotor disks 238, 242, each with a circumferential series of rotor blades 240, 244 extending into the flow path 230. As the rotor blades 240, 244 rotate, air flowing through the flow path 230 is compressed. As noted above, the compressor rotor assemblies 234, 237 may be driven by the turbine section 150 via the shaft assembly 170.

As also noted above, the compressed air from the compressor section 130 is mixed with fuel and ignited in a combustor 142 of the combustion section 140 to generate high energy combustion gases that are directed into the turbine section 150, particularly the high pressure turbine 152. The high pressure turbine 152 generally includes one or more turbine stator assemblies (or nozzles) 254 and one or more turbine rotor assemblies 256. Each turbine rotor assembly 256 includes a turbine rotor disk 258 with a circumferential series of turbine rotor blades 260 extending from the turbine rotor disk 258. As the combustion gases flow through the high pressure turbine 152, the rotor blades 260 rotate to drive the rotor disk 258, which in turn, is coupled to the shaft assembly 170 to drive various components, such as the high pressure compressor 132.

The shaft assembly 170 includes a tie shaft 300 that functions to axially retain the rotating components of the high pressure core 202, particularly the compressor rotor assemblies 234, 237 of the high pressure compressor 132 and the turbine rotor assembly 256 of the high pressure turbine 152. The tie shaft 300 may also retain various other components, such as bearings 354; seals 352, 356; shaft components 282, 286; shims 358; and/or other components as needed. Collectively, the retained components associated with the tie shaft 300 may be referred to as a component group or rotating component group. The components of the component group are maintained radially concentric to one another, while in one exemplary embodiment, the tie shaft 300 provides only the axial load necessary to retain the relative positions.

In addition to the tie shaft 300, the shaft assembly 170 may include one or more components that facilitate the transfer of torque within the rotating group. These components may be generally referred to as a power shaft assembly (portions of which are shown in FIG. 2) and are typically positioned concentric to the tie shaft 300. In particular, a forward shaft component 282 functions to couple the tie shaft 300 to other components of the power shaft assembly and rotating group components for common rotation during operation, as described below. However, during an assembly or disassembly operation, the tie shaft 300 may be decoupled from the forward shaft component 282 to enable independent rotation, as also described below.

As further described below, the tie shaft 300 is typically "stretched" upon installation or service by a tension force on the tie shaft 300 to result in the decoupling of the tie shaft 300 and rotating group components to enable assembly and/or disassembly. Additionally, upon release of this tension force, the tie shaft 300 exerts the above-referenced inward axial force on the components to maintain the relative positions and alignments during operation. The discussion below particularly details the structure of tie shaft 300 and systems and methods for stretching the tie shaft 300 such that, during the stretching operation, portions of the high pressure core 202 may be assembled and disassembled, and upon completion of the stretching operation, the inward axial retention force is applied in preparation for engine operation. In particular, the high pressure turbine rotor assembly 256 portion may be more easily removed for maintenance, thereby also providing access to the high pressure turbine nozzle 254 and combustor 142, as needed. In the discussion below, the "stretching" operation refers to the preparation, installation and/or application of the tension force resulting in the inward axial retention force and/or assembly or disassembly for servicing.

As shown, the tie shaft 300 has a cylindrical body 302 extending from a first (or forward) end 310 to a second (or aft) end 312 through a collective bore 206 generally defined by the annular nature of the high pressure core 202. In one exemplary embodiment, the first and second ends 310, 312 are arranged and positioned such that the entire tie shaft 300 is considered to be completely internal to the rotating component group of the high pressure core 202. In other words, the first end 310 of the tie shaft 300 is aft of the forward end of the most forward rotating component, which in the depicted exemplary embodiment is shaft component 282. On the other side, the second end 312 is forward of the aft end of the most aft rotating component, which in the depicted exemplary embodiment is turbine rotor assembly 256 of the high pressure turbine 152. As a result of this arrangement, no axial face of the tie shaft 300 may be accessible by tooling for the stretching operation. In other exemplary embodiments, the tie shaft 300 may extend beyond the ends of the rotating components.

The first end 310 of the tie shaft 300 has a protrusion 320 that forms an axial face 322 facing the aft direction. The axial face 322, in the position shown, is pressed against a collar 280, which in turn is coupled to shaft component 282, introduced above. When the tie shaft 300 is in the position shown in FIG. 2, the tie shaft 300 axially retains the rotating group components via the interface formed by the axial face 322 and collar 280.

The shaft component 282 and/or collar 280 may define a recess 284 to accommodate the protrusion 320 and first end 310 of the tie shaft 300. The recess 284 may be sized to additionally accommodate some amount of axial movement of the first end 310 of the tie shaft 300. As described below, during the stretching operation, the tie shaft 300 is stretched such that the first end 310 moves in an axial forward direction, and as a result of this movement, the axial face 322 may separate from the collar 280. Upon separation, the tie shaft 300 is rotationally decoupled from the compressor rotor assembly 234 and may rotate separately from other components of the shaft assembly 170. In other words, upon separation of the axial face 322 and collar 280, there is no feature that restricts rotation of tie shaft 300 relative to shaft component 282.

The cylindrical body 302 of the tie shaft 300 defines an external (or outer) surface 304 and an internal (or inner) surface 306 that forms an internal bore 308. The external surface 304 of the tie shaft 300 includes external threads 324 at the second end 312 upon which the turbine rotor assembly 256 is mounted with corresponding threads. As described below, the turbine rotor assembly 256 may be removed from the tie shaft 300 by counter-rotating the tie shaft 300 and turbine rotor assembly 256 to uncouple the threaded engagement. A retaining ring 382 may also be positioned on the external surface 304 to assist disassembly.

The internal surface 306 of the tie shaft 300 defines a first set of internal grooves (or rings) 330 proximate to the first end 310 and a second set of internal grooves 332 proximate to the second end 312. As described in greater detail below, the internal grooves 330, 332 enable engagement with a tool assembly that may be used to stretch the tie shaft 300 and assemble and/or disassemble the high pressure core 202 relative to the tie shaft 300. One or both sets of the grooves 330, 332 may be concentric, e.g. separate circumferential grooves, such that control of the angular position of the tool assembly is not required. Furthermore, each of the grooves 330, 332 may be shaped such that the load capability is increased in the desired direction consistent with the application of stretch tool load. In other words, the wall of the respective groove on the side of the desired direction (e.g., the forward side wall of grooves 330 and the aft side wall of grooves 332) may be angled inward or perpendicular to a radial plane to enhance load bearing characteristics, although other configurations and groove shapes are possible. In one exemplary embodiment, the shape of the grooves 330, 332 may closely resemble the shape of buttress threads, albeit formed as separate, concentric circumferential grooves, rather than the typical, helical, threaded form. As such, in some embodiments, the grooves 330, 332 may be referred to as buttress rings. In alternate embodiments, the grooves 330, 332 may have such a helical or threaded form. In the depicted embodiment, the grooves 330, 332 are formed within the internal surface 306, although in other embodiments, the grooves 330, 332 may be formed by lands extending from the internal surface 306.

The tie shaft 300 may further include one or more internal slots 340, 342 extending from the internal surface 306 into or through the body 302. In one exemplary embodiment, the tie shaft 300 may have a first circumferential series or row of slots 340 proximate to the first set of internal grooves 330 and a second circumferential series or row of slots 342 proximate to the second set of internal grooves 332. As described in greater detail below, the slots 340, 342 enable rotatable coupling of the tie shaft 300 to the tool assembly as needed to assemble and/or disassemble the high pressure core 202 relative to the tie shaft 300. An exemplary tool assembly will be introduced prior to a description of the engagement and function with respect to the tie shaft 300.

Figure 3:
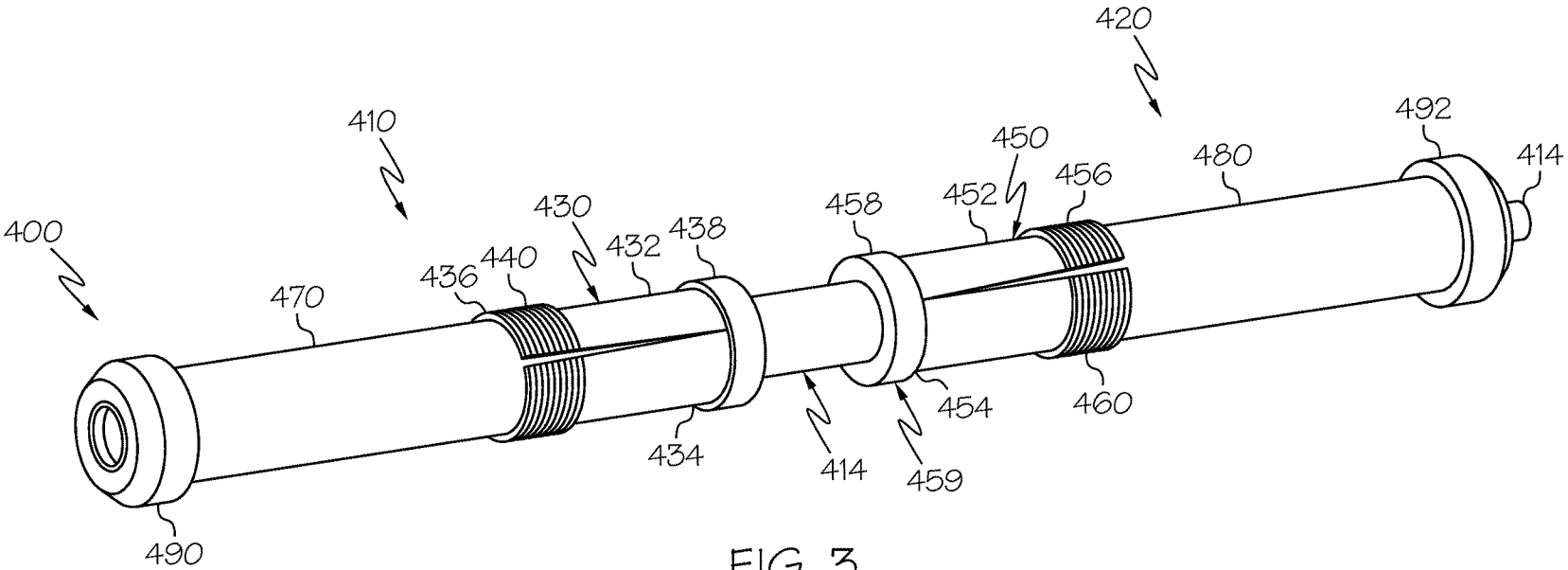
FIG. 3 is an isometric view of a tool assembly in accordance with an exemplary embodiment.

Reference is made to FIG. 3, which is a perspective view of a tool assembly 400 for engagement with a tie shaft (e.g., tie shaft 300 of FIG. 2) in accordance with an exemplary embodiment. The tool assembly 400 includes a forward tool portion 410 and an aft tool portion 420. As shown, each of the tool portions 410, 420 has a cylindrical configuration, and the forward and aft tool portions 410, 420 may have a telescoping, sliding engagement relative to one another.

In this exemplary embodiment, the forward tool portion 410 has a forward expander 470 and a main body 414. Generally, the main body 414 extends the entire length of tool assembly 400 and includes segments or portions that are sized to accommodate concentric, axial movement relative to the aft tool portion 420 and the aft expander 480. As described below, the aft tool portion 420 includes an aft tool body 459 and an aft expander 480. The aft tool body 459 and aft expander 480 are sized such that the aft tool body 459 slides over a portion of the main body 414 and the aft expander 480 slides over the aft tool body 459.

As also shown in FIG. 3, the tool assembly 400 further includes two or more jaw members 432 that form a forward jaw set 430 on the outer periphery of the main body 414. In one exemplary embodiment, the forward jaw set 430 includes three jaw members 432, although any suitable number may be provided. Each jaw member 432 of the forward jaw set 430 has a first end 434 mounted to the main body 414 at a hinge 438 and a second end 436 with outer circumferential grooves 440. At each hinge 438, the respective jaw member 432 is mounted to pivot between expanded and collapsed positions.

As described below, the outer circumferential grooves 440 of the forward jaw set 430 are configured to match and mate with the forward internal grooves 330 of the tie shaft 300 (FIG. 2) when the jaw members 432 are in the expanded position. In some embodiments, one or more of the forward jaw members 432 may include pins that engage, in the expanded position, with corresponding slots 340 in the tie shaft 300 (FIG. 2), as discussed below. Moreover, in some exemplary embodiments, the jaw members 432 may have a ring groove and a retaining ring (or o-ring) arranged within the ring groove, as more clearly shown in subsequent views. Such a retaining ring functions to bias the jaw members 432 of the forward jaw set 430 into the collapsed position.

The tool assembly 400 further includes one or more jaw members 452 that form an aft jaw set 450 on the outer periphery of the aft tool portion 459. In one exemplary embodiment, the aft jaw set 450 includes three jaw members 452, although any suitable number may be provided. Each jaw member 452 of the aft jaw set 450 has a first end 454 mounted to the aft tool portion 420 at a hinge 458 and a second end 456 with outer circumferential grooves 460. Similar to the forward jaw set 430, each respective jaw member 452 is mounted to pivot at the respective jaw hinge 458 between expanded and collapsed positions.

As described below, the outer circumferential grooves 460 of the aft jaw set 450 are configured to match and mate with the aft internal grooves 332 of the tie shaft 300 (FIG. 2) when the jaw members 452 are in the expanded position. In some embodiments, one or more of the aft jaw members 452 may include pins that engage, in the expanded position, with corresponding slots 342 in the tie shaft 300 (FIG. 2), as discussed below. Moreover, in some exemplary embodiments, the jaw members 452 may have a ring groove and a retaining ring (or o-ring) arranged within the ring groove, as more clearly shown in subsequent views. Such a retaining ring functions to bias the jaw members 452 of the aft jaw set 450 into the collapsed position. In some exemplary embodiments, the grooves 440, 460 may be considered buttress rings, and in further exemplary embodiments, the grooves 440, 460 may be threaded or helical. Generally, as used herein with respect to grooves 330, 332, 440, 460, the term "grooves" may refer to both threaded or helical arrangements and concentric arrangements.

As introduced above, the tool assembly 400 further includes forward and aft expanders 470, 480. The forward expander 470 is generally cylindrical with a slightly larger diameter than the main body 414 of the forward tool portion 410. During the stretching operation, as described in greater detail below, the forward expander 470 slides over the forward end of the main body 414 and the leading edge slips between the jaw set 430 and the outer surface of the main body 414. As a result of this movement, the jaw members 432 are pivoted from the collapsed position to the expanded position.

The aft expander 480 functions in a similar manner as the forward expander 470. The aft expander 480 is generally cylindrical with a slightly larger diameter than the aft tool body 459. During the stretching operation, as described in greater detail below, the aft expander 480 slides over the aft end of the aft tool body 459 and the leading edge slips between the aft jaw set 450 and the outer surface of the aft tool body 459. As a result of this movement, the jaw members 452 are pivoted from the collapsed position to the expanded position.

The tool assembly 400 further includes forward and aft retention members 490, 492. The forward and aft retention members 490, 492 are internally threaded nut-type members. In one exemplary embodiment, the forward retention member 490 engages the forward end of the main body 414 of the forward tool portion 410 to retain the axial position of the forward expander 470. Similarly, the aft retention member 492 engages the aft end of the aft tool portion 459 to retain the axial position of the aft expander 480.

Now that the tie shaft 300 and tool assembly 400 have been introduced in FIGS. 2 and 3, additional details about stretching operation, including disassembling and assembling the high pressure core 202, will now be provided with reference to FIGS. 4-15. Generally, the views of FIGS. 4-15 and the associated discussion below are presented in the sequence of a disassembly operation, while the sequence of an assembly operation is reversed.

Figure 4:
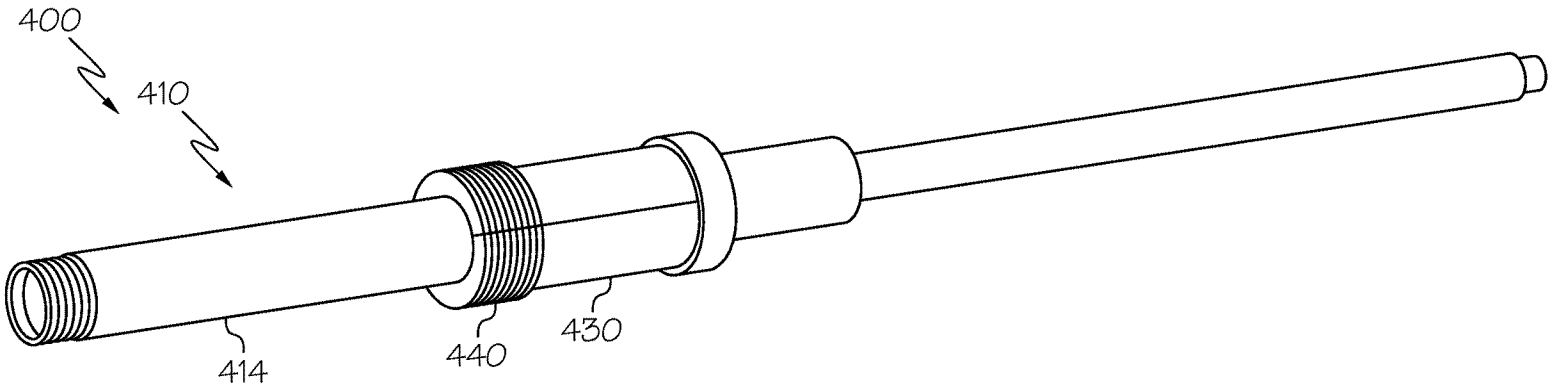
FIGS. 4-15 are partial isometric and/or cross-sectional views of the tie shaft of FIG. 2 and the tool assembly of FIG. 3 during a disassembly procedure in accordance with an exemplary embodiment.

FIG. 4 is a partial perspective view of the tool assembly 400. Generally, FIG. 4 depicts portions of the tool assembly 400 as the tool assembly itself is assembled and deployed relative to the tie shaft 300 (FIG. 3). In FIG. 4, the surrounding tie shaft 300 and other engine components are omitted for clarity. Initially, during deployment for the stretching operation, the main body 414 of the forward tool portion 410 is inserted through the bore 308 of the tie shaft 300 (FIG. 2) with the forward jaw set 430 in the collapsed position. Although the tie shaft 300 is omitted in FIG. 4, the main body 414 is generally positioned within the tie shaft 300 such that the circumferential grooves 440 of the forward jaw set 430 are approximately radially aligned with the internal grooves 330, as more clearly shown and described with reference to FIGS. 5 and 6.

Figure 5:
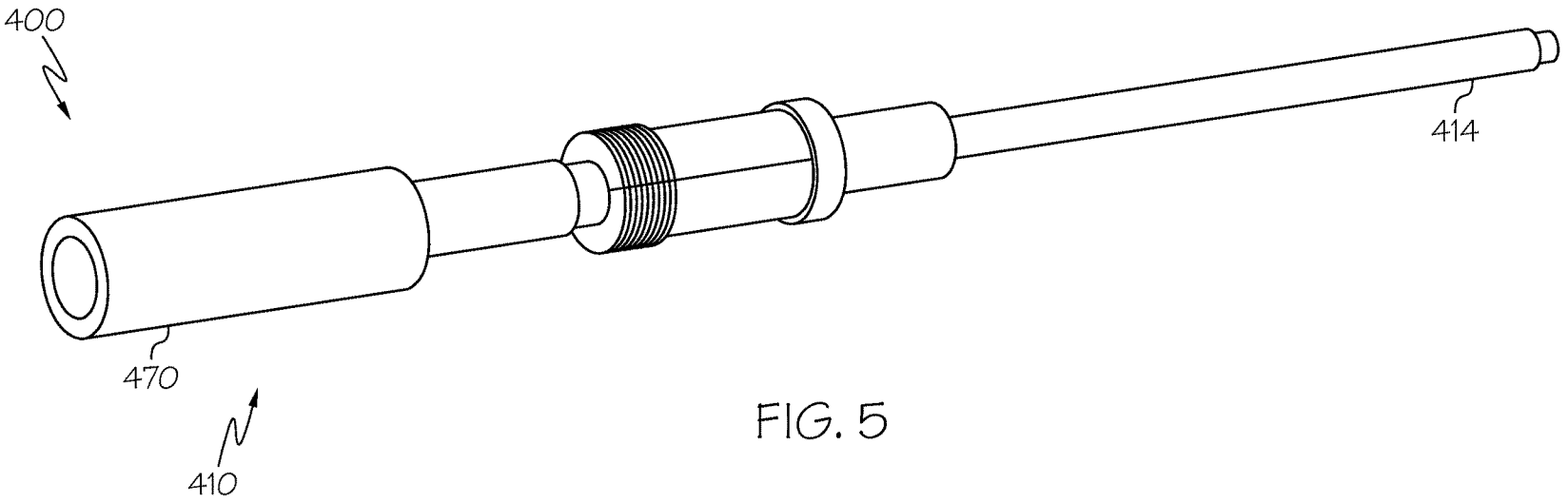
Figure 6:
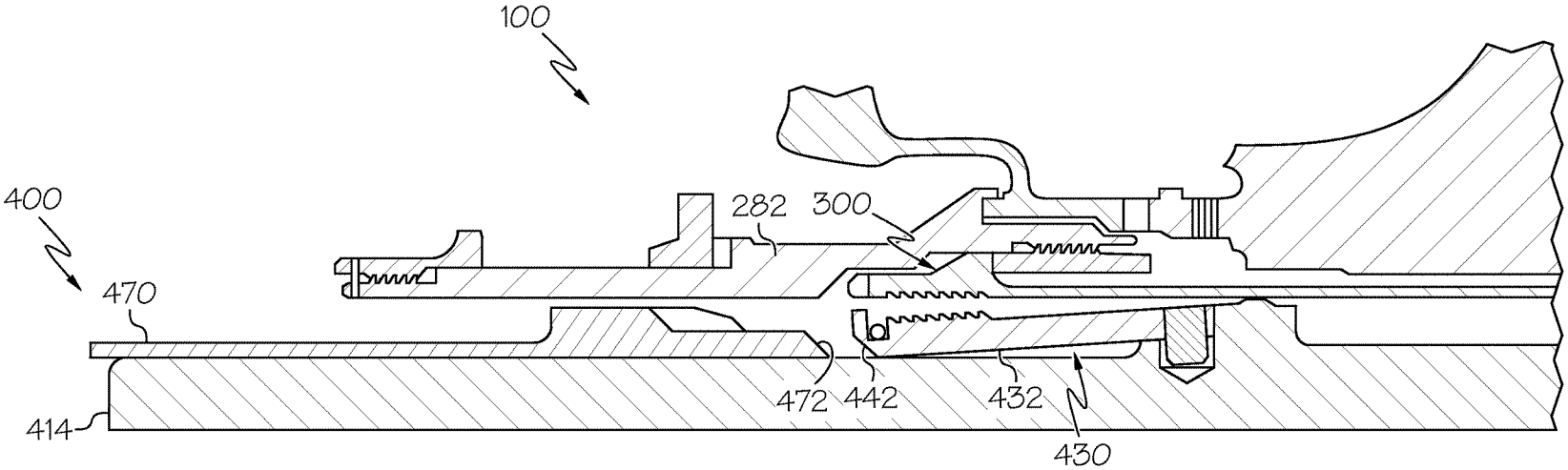

FIG. 5 is a further view depicting a partial perspective view of the tool assembly 400 during deployment subsequent to the view of FIG. 4. Like FIG. 4, the surrounding tie shaft 300 and other engine components are omitted for clarity in FIG. 5. In FIG. 5, the forward expander 470 is inserted onto the main body 414 from the forward side. FIG. 6 is a more detailed cross-sectional view of the forward expander 470 being inserted along the main body 414 of the tool assembly 400, and additionally shows aspects of the engine 100, particularly portions of the tie shaft 300 and shaft component 282. As shown in FIG. 6, the forward expander 470 has a beveled and angled leading edge 472, and the jaw members 432 of the forward jaw set 430 have corresponding beveled and angled leading edges 442 such that the forward expander 470 passes between the jaw members 432 and the main body 414 as the forward expander 470 advances along the forward end of main body 414.

Figure 7:
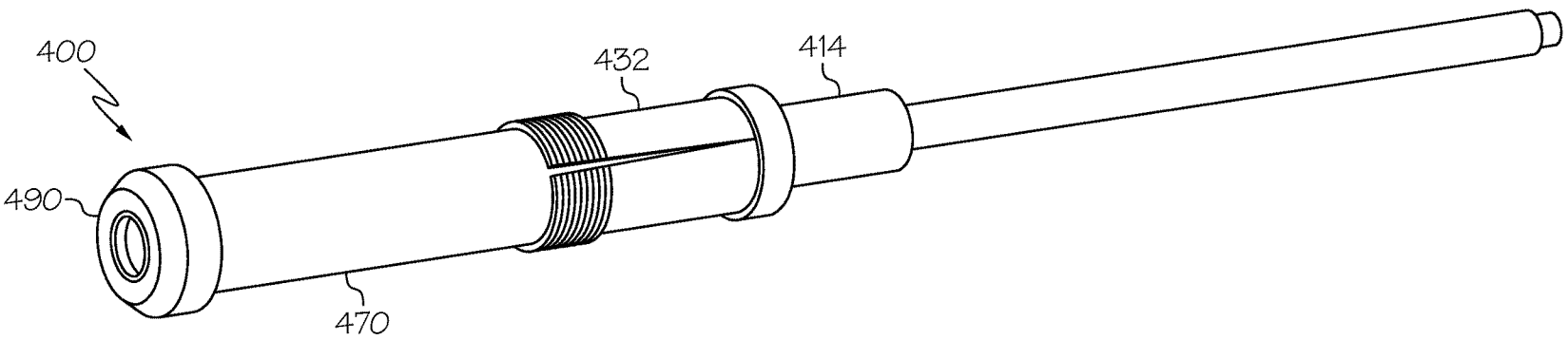
Figure 8:
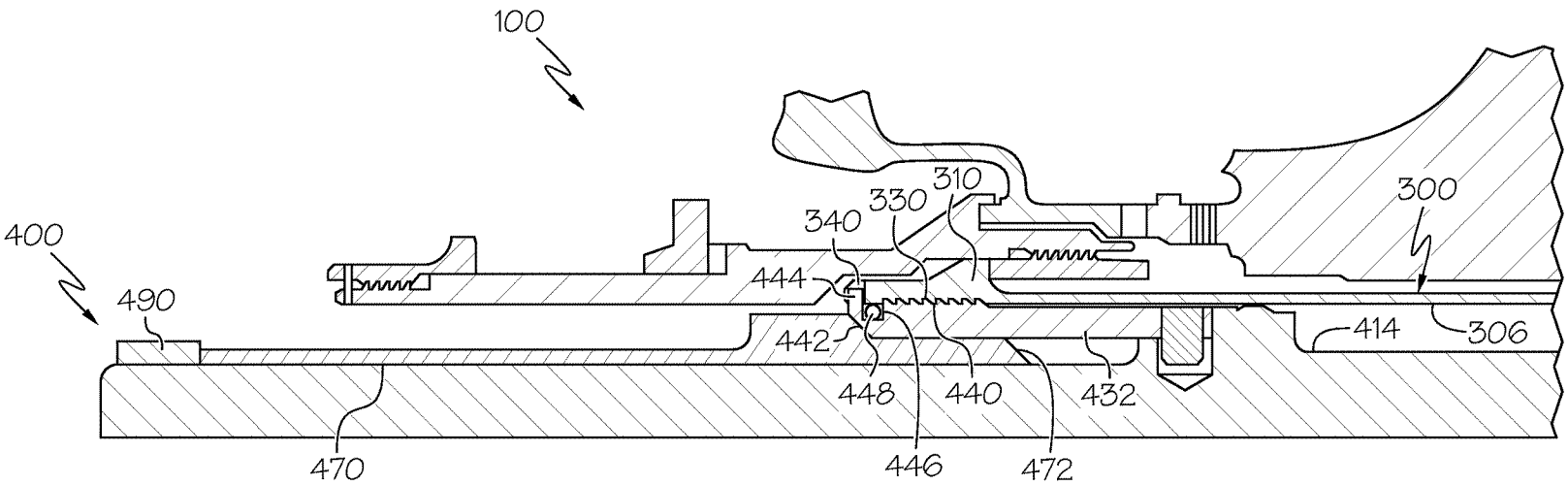

FIG. 7 is a further view depicting a partial perspective view of the tool assembly 400 during deployment subsequent to the view of FIGS. 5 and 6. In FIG. 7, the surrounding tie shaft 300 and other engine components are omitted for clarity. As shown, the forward expander 470 has been advanced such that forward expander 470 positioned between the jaw members 432 and the main body 414. As a result of this position, the jaw members 432 have been urged into the expanded position. Upon reaching the appropriate axial position, the forward expander 470 may be secured by the forward retention member 490, which is screwed onto the forward end of the main body 414. FIG. 8 is a more detailed cross-sectional view of the main body 414 and the forward retention member 490 in these positions relative to the tie shaft 300. As shown in FIG. 8, in the expanded position, the circumferential grooves 440 engage with the forward internal grooves 330 on the internal surface 306 of the tie shaft 300. Additionally, FIG. 8 more clearly depicts the pins 444 on the jaw members 432 that engage the slots 340 on the forward end 310 of the tie shaft 300. In this position, the forward end 310 of the tie shaft 300 is rotationally coupled to the tool assembly 400 as a result of the engagement between the pins 444 on the jaw members 432 and the slots 340 of the tie shaft 300 and additionally axially coupled to the tool assembly 400 as a result of the engagement between the circumferential grooves 440 of the jaw members 432 and the forward internal grooves 330 on the tie shaft 300.

FIG. 8 additionally depicts the ring groove 446 on the jaw members 432 and the retaining ring 448 extending within the ring groove 446. As noted above, the retaining ring 448 functions to bias the jaw members 432 into the collapsed position until being forced into the expanded position by the forward expander 470.

Figure 9:
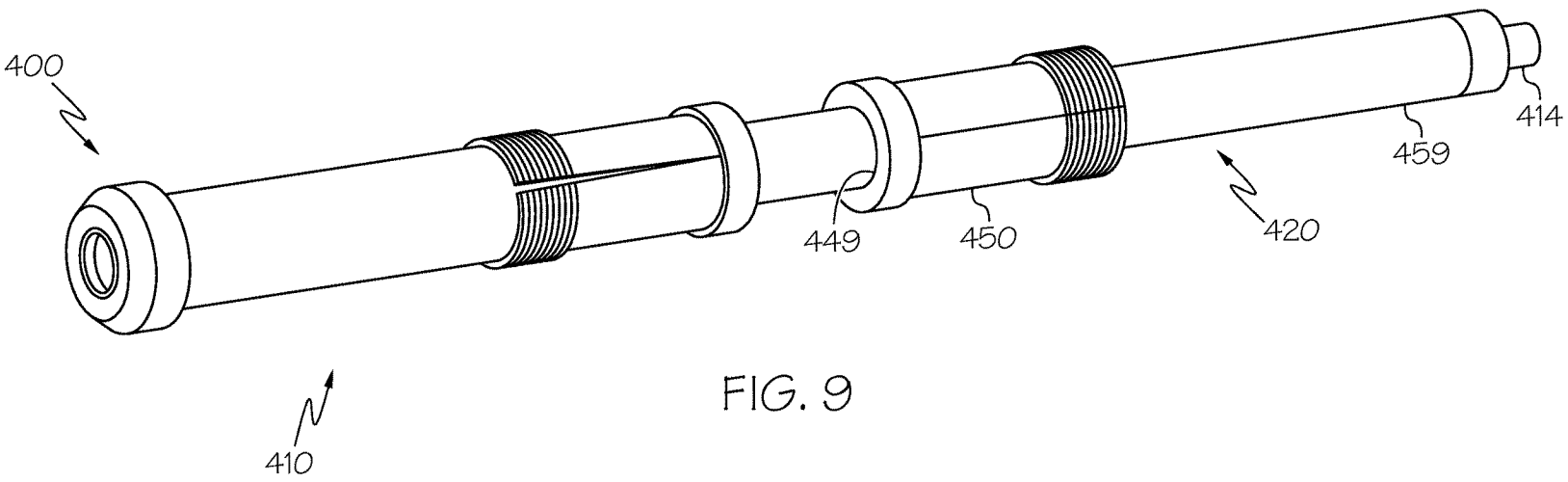

FIG. 9 is a further view depicting a partial perspective view of the tool assembly 400 during deployment subsequent to the view of FIGS. 7 and 8. In FIG. 9, the surrounding tie shaft 300 and other engine components are omitted for clarity. As shown, the aft tool portion 420 is inserted into the bore 308 of the tie shaft 300 (not shown in FIG. 9) from the aft side. As shown, the aft tool body 459 is inserted around and along the aft end of the main body 414. The aft tool body 459 is inserted with the aft jaw set 450 in a collapsed portion. The main body 414 may have an expanded diameter stop member 449 to provide an indication of the proper position of the aft tool body 459 relative to the forward tool portion 410. Although the tie shaft 300 is omitted in FIG. 9 for clarity, the aft tool body 459 is generally positioned within the tie shaft 300 such that the circumferential grooves 460 of the aft jaw set 450 are approximately radially aligned with the internal grooves 332, as more clearly shown and described below with reference to FIG. 11.

Figure 10:
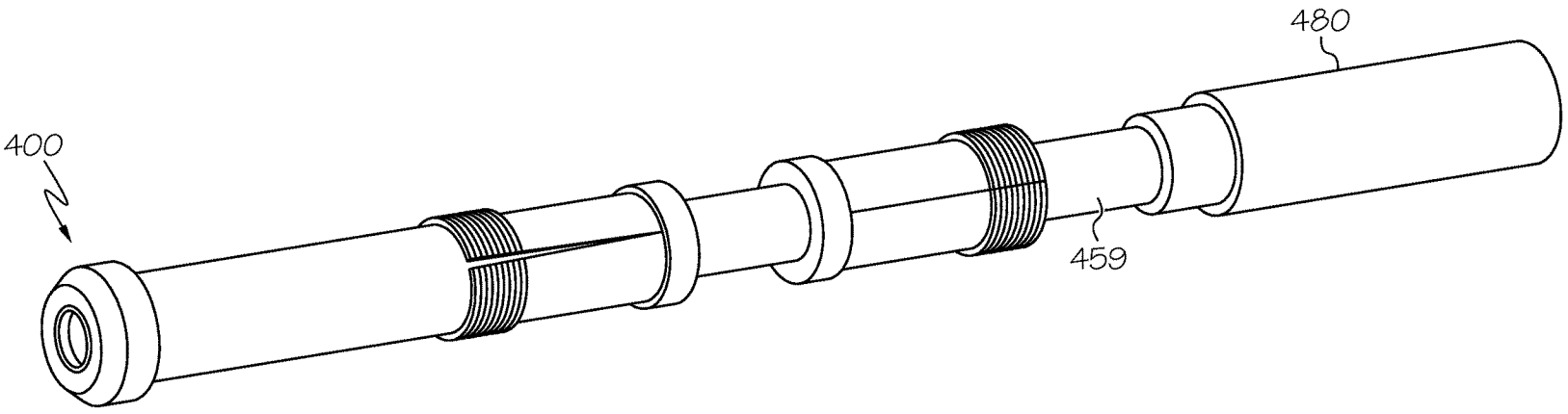
Figure 11:
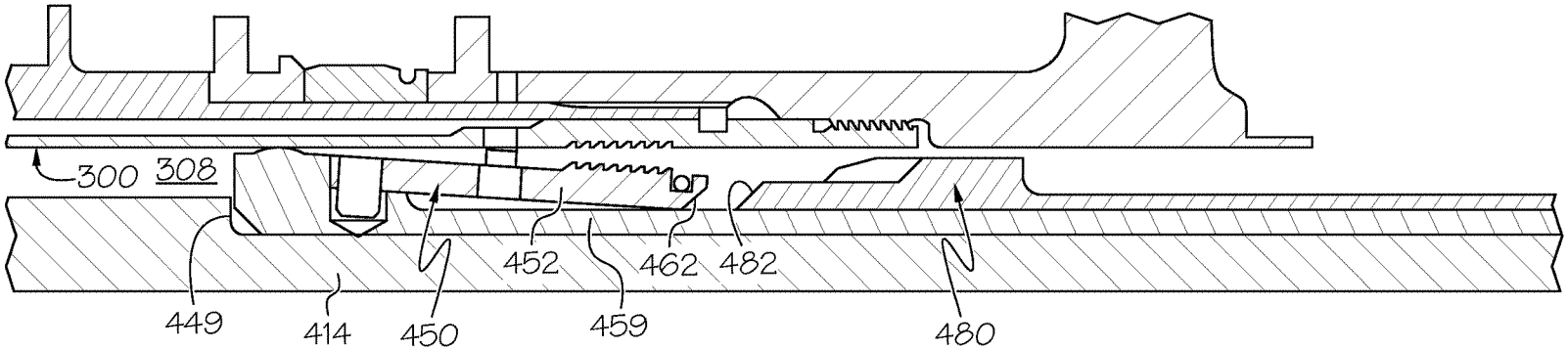

FIG. 10 is a further view depicting a partial perspective view of the tool assembly 400 during deployment subsequent to the view of FIG. 9. In FIG. 10, the surrounding tie shaft 300 and other engine components are omitted for clarity. The aft expander 480 is inserted into the bore 308 of the tie shaft 300 (FIG. 11) from the aft side onto the aft tool body 459. FIG. 11 is a more detailed cross-sectional view of the aft expander 480 being inserted along the aft tool body 459. As shown in FIG. 11, the aft expander 480 has a beveled and angled leading edge 482, and the jaw members 452 of the aft jaw set 450 have corresponding beveled and angled leading edges 462 such that the aft expander 480 passes between the jaw members 452 and the aft tool body 459 as the aft expander 480 advances along the aft tool body 459.

Figure 12:
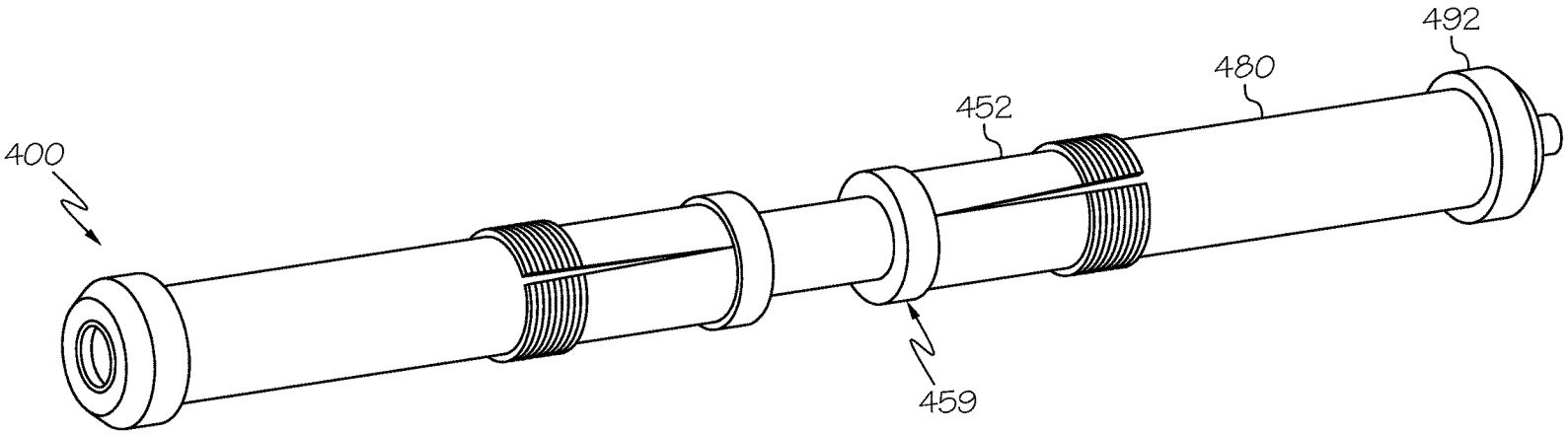
Figure 13:
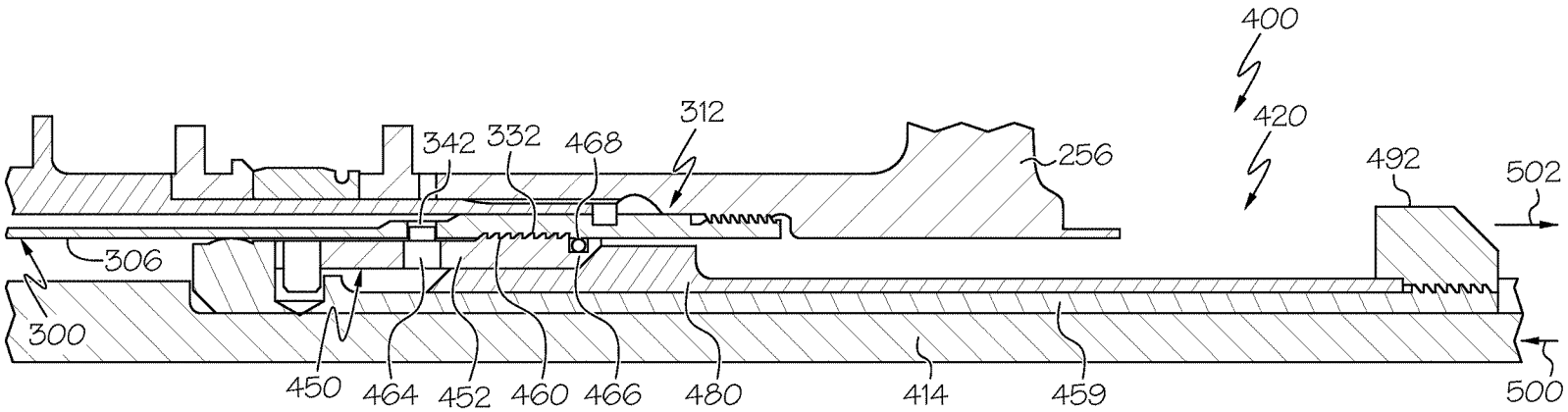

FIG. 12 is a further view depicting a partial perspective view of the tool assembly 400 during deployment subsequent to the view of FIGS. 10 and 11. In FIG. 12, the surrounding tie shaft 300 and other engine components are omitted for clarity. As shown, the aft expander 480 has been advanced such that aft expander 480 is positioned between the jaw members 452 and the aft tool portion 459. As a result of this position, the jaw members 452 have been urged into the expanded position. Upon reaching the appropriate axial position, the aft expander 480 is secured in this position by the aft retention member 492, which is screwed onto the aft tool body 459. FIG. 13 is a partial, more detailed cross-sectional view of the aft tool portion 420 and the aft retention member 492 in these positions relative to the tie shaft 300. As shown in FIG. 13, in the expanded position, the circumferential grooves 460 on the aft jaw set 450 engage with the aft internal grooves 332 on the internal surface 306 of the tie shaft 300.

Additionally, FIG. 13 more clearly depicts the pins 464 on the jaw members 452 that engage the slots 342 on the aft end 312 of the tie shaft 300. In this position, the aft end 312 of the tie shaft 300 is rotationally coupled to the tool assembly 400 as a result of the engagement between the pins 464 of the jaw members 452 and the slots 342 of the tie shaft 300 and additionally axially coupled to the tool assembly 400 as a result of the engagement between the circumferential grooves 460 of the jaw members 452 and the aft internal buttress rings 332 on the tie shaft 300.

FIG. 13 additionally depicts the ring groove 466 on the jaw members 452 and the retaining ring 468 extending within the ring groove 466. As noted above, the retaining ring 468 functions to bias the jaw members 452 into the collapsed position until being forced into the expanded position by the aft expander 480.

As such, in the position depicted in FIGS. 12 and 13, the tool assembly 400 is engaged with the tie shaft 300 via both sets of internal grooves 330, 332. In this position, as partially shown in FIG. 13, the main body 414 extends beyond the aft end of the aft tool portion 420. In this position, a hydraulic ram (not shown) or other equipment may be used to press the main body 414 in a forward direction from the aft end, as represented by arrow 500. At the same time, the aft tool body 459 is pulled in an aft direction or maintained in position at the aft retention member 492, as indicated by arrow 502. As a result of these forces 500, 502, the main body 414 and aft tool body 459 are translated relative to each other such that the total length of the tool assembly 400 is increased. Since the forward and aft tool portions 410, 420 are engaged with the internal grooves 330, 332 of the tie shaft 300, the lengthening of the tool assembly 400 functions to stretch the tie shaft 300 in the axial direction.

Figure 14:
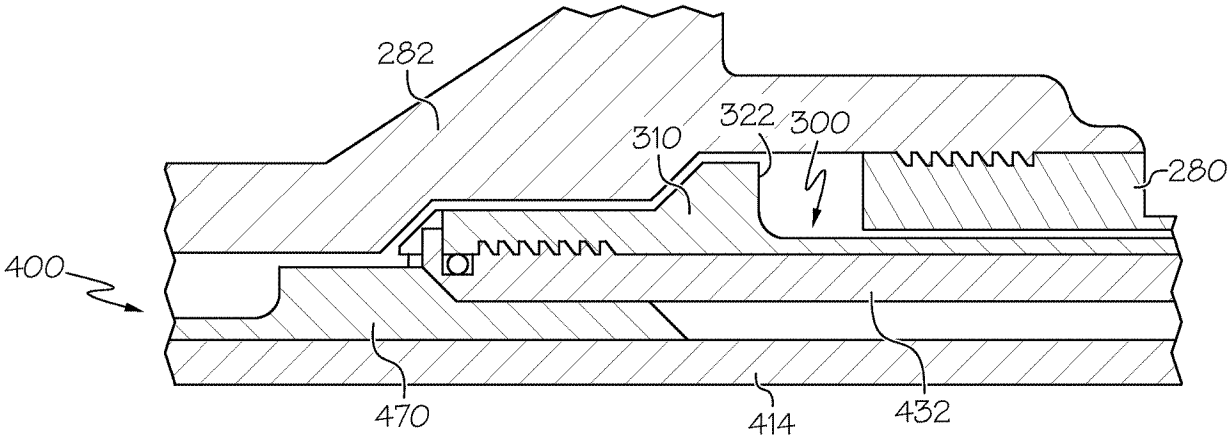

FIG. 14 is a partial cross-sectional view of the stretched tie shaft 300 at the forward end 310. As the tie shaft 300 is stretched, the axial face 322 separates from the collar 280, thereby decoupling the tie shaft 300 from the collar 280 and other portions of the rotating components, including the compressor rotor assembly 234, such that the tie shaft 300 may rotate independently.

Upon separation, a first rotating tool (not shown) may be inserted to counter-rotate the high pressure turbine rotor assembly 256 (e.g., FIG. 13), and consequently, the power shaft assembly, and a second rotating tool (not shown) may be used to rotate the tool assembly 400, and consequently, the tie shaft 300. The first and second rotating tools may be any suitable tooling components, including wrenches or tangs. In one exemplary embodiment, the second rotating tool may be formed by tangs on the reaction tool represented by force 502 (FIG. 13). As noted above, for example, in the description of FIG. 2, the high pressure turbine rotor assembly 256 has a threaded or screw engagement with the tie shaft 300. As a result of the relative rotations, the high pressure turbine rotor assembly 256 is decoupled from the tie shaft 300 and may be removed from the aft end 312. As noted above, the retaining ring 382 (FIG. 2) may be employed to retain the positions of the rotating group components in this position.

Figure 15:
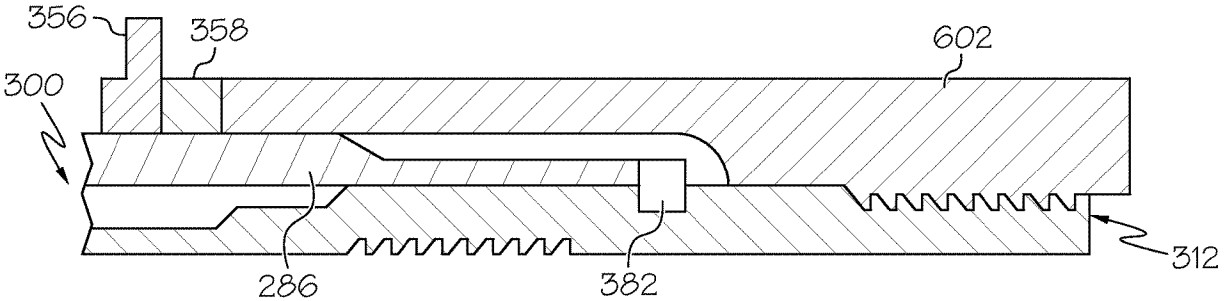

FIG. 15 is a partial cross-sectional view of the remaining components of the high pressure core 202 and tie shaft 300 after removal of the high pressure turbine rotor assembly 256 (see, e.g., FIG. 13). In this position, a rotor group retention member 602 may be installed on the aft end 312 of the tie shaft 300 to secure the remaining portions of the high pressure core 202, either temporarily or for storage. The rotor group retention member 602 may be a nut-type attachment with threads that engage the threads that previously retained the removed turbine rotor assembly 256. As a result, the high pressure turbine rotor assembly 256 may be removed and the remainder of the rotating group of the high pressure core 202 may remain intact or subject to further disassembly. In this position, the turbine nozzle 254 and liner of the combustor 142 may also be removed.

In one exemplary embodiment and referring to FIGS. 3-15, the tool assembly 400 may be removed by decoupling the aft retention member 492, then removing the aft expander 480, then removing the aft tool body 459, then removing forward retention member 490, then removing the forward expander 470, and then removing the main body 414.

As a result of the interaction between the tie shaft 300 and tool assembly 400, assembly and disassembly do not require any design changes in disk bore diameters relative to previous arrangements to enable modular disassembly of more efficient maintenance. Although the tie shaft 300 and tool assembly 400 are described above with respect to a high pressure core, exemplary embodiments discussed above may be implemented with any type of rotating group and/or rotor assembly. For example, exemplary embodiments of the shaft assembly and tool assembly described above may be used in a rotating group with only two members, including only two compressor assemblies or only two turbine rotor assemblies. The exemplary embodiments discussed above provide modularity capability for more efficient assembly and disassembly of selective components, particularly without requiring complete disassembly of the gas turbine engine. Exemplary embodiments are applicable to both commercial and military gas turbine engines and auxiliary power units. Moreover, exemplary embodiments may find beneficial uses in many industries, including aerospace and particularly in high performance aircraft, as well as automotive, marine and power generation.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A tie shaft for a rotating group of an engine core, comprising:

a cylindrical body having an internal surface and an external surface and extending between a forward end and an aft end;

a first group of internal grooves on the internal surface of the cylindrical body proximate to the forward end; and a second group of internal grooves on the internal surface of the cylindrical body proximate to the aft end, wherein the cylindrical body includes at least one set of slots extending from the internal surface proximate to at least one of the first group of internal grooves and the second group of internal grooves.

2. The tie shaft of claim 1, wherein the first group of internal grooves is a first group of buttress rings, and wherein the second group of internal grooves is a second group of buttress rings.

3. The tie shaft of claim 2, wherein the first group of buttress rings and the second group of buttress rings are concentric, circumferential rings.

4. The tie shaft of claim 2, wherein each of the first group of buttress rings includes a first surface that engages a first axial load in a first direction, and wherein each of the second group of buttress rings includes a second surface that engages a second axial load in a second direction.

5. The tie shaft of claim 1, wherein the first group of internal grooves is configured to engage a first stretch load in a first direction and the second group of internal grooves is configured to engage a second stretch load in a second direction.

6. The tie shaft of claim 1, wherein the external surface of the cylindrical body is free from axial surfaces configured to engage an axial stretch load.

7. A rotating assembly for a gas turbine engine, comprising:

at least two rotating group components defining a bore; and a tie shaft extending through the bore and axially retaining the at least two rotating group components during operation of the gas turbine engine, the tie shaft having a cylindrical body with a forward end and an aft end and defining an interior surface, wherein the tie shaft comprises a first at least one internal groove on the interior surface of the cylindrical body at the forward end and a second at least one internal groove on the interior surface of the cylindrical body at the aft end, wherein the cylindrical body includes at least one set of slots extending from the internal surface proximate to at least one of the first at least one internal groove and the second at least one internal groove.

8. The rotating assembly of claim 7, wherein the tie shaft is configured to receive a stretch load from a stretch tooling assembly via the first at least one internal groove and the second at least one internal groove.

9. The rotating assembly of claim 8, wherein the tie shaft is only configured to receive the stretch load from the stretch tooling assembly via the first at least one internal groove and the second at least one internal groove.

10. The rotating group of claim 7, wherein the at least two rotating group components include at least two compressor rotor assemblies.

11. The rotating group of claim 7, wherein the at least two rotating group components include at least one compressor rotor assembly and at least one turbine rotor assembly.

12. The rotating group of claim 7, wherein the gas turbine engine includes a compression section and a turbine section such that the at least one compressor rotor assembly includes a first compressor rotor assembly at a forward-most position in the compression section and the at least one turbine rotor assembly includes a first turbine rotor assembly at an aft-most position in the turbine section, and wherein the forward end of the tie shaft terminates aft of a forward-most point of the first compressor rotor assembly and the aft end of the tie shaft terminates forward of an aft-most portion of the second turbine rotor assembly.

13. The rotating group of claim 7, wherein the first at least one internal groove comprises a first group of buttress rings, and wherein the second at least one internal groove comprises a second group of buttress rings.

14. The rotating group of claim 13, wherein the first group of buttress rings and the second group of buttress rings are concentric, circumferential rings.

15. The rotating group of claim 7, wherein the first at least one internal groove is configured to engage a first stretch load in a first direction and the second at least one internal groove is configured to engage a second stretch load in a second direction.

16. A method for servicing an engine assembly with a rotating group axially retained by a tie shaft, the tie shaft comprising a cylindrical body having an internal surface and an external surface and extending between a forward end and an aft end; a first group of internal grooves on the internal surface of the cylindrical body proximate to the forward end; and a second group of internal grooves on the internal surface of the cylindrical body proximate to the aft end, the method comprising the steps of:

inserting a stretch tool assembly through the tie shaft;

exerting an outward axial force on the internal surface of the tie shaft at the forward end and at the aft end to stretch the tie shaft to axially decouple the tie shaft from the rotating group;

wherein the exerting step includes exerting the outward axial force at the forward end via the first group of internal grooves and at the aft end via the second group of internal grooves, and wherein the inserting step comprises:

inserting a tool main body of the tool assembly through a bore of the tie shaft, the tool assembly further including a first set of jaw members on the tool main body with a first set of circumferential grooves, wherein the tool main body portion is inserted into the bore of the tie shaft with the first set of jaw members in a collapsed position;

expanding the first set of jaw members on the forward tool portion into an expanded position such that the first set of circumferential grooves on the first set of jaw members engage the first group of internal grooves;

inserting an aft tool portion through the bore of the tie shaft, the aft tool portion including a second set of jaw members having a second set of circumferential grooves, wherein the aft tool portion is inserted into the bore of the tie shaft with the second set of jaw members in a collapsed position; and expanding the second set of jaw members on the aft tool portion into an expanded position such that the second set of circumferential grooves on the second set of jaw members engage a second group of internal grooves; and removing at least one component of the rotating group from the tie shaft.

* * * * *